United States Patent [19]

Sasaki

[11] Patent Number: 4,707,436

[45] Date of Patent: Nov. 17, 1987

[54] COLOR PHOTOGRAPHIC MATERIAL

[75] Inventor: Noboru Sasaki, Kanagawa, Japan

[73] Assignee: Fuji Photo Film Co., Ltd., Kanagawa, Japan

[21] Appl. No.: 835,030

[22] Filed: Feb. 28, 1986

[30] Foreign Application Priority Data

Feb. 28, 1985 [JP] Japan ..... 60-39734

[51] Int. Cl.[4] ..... G03C 7/32

[52] U.S. Cl. ..... 430/504; 430/505; 430/506

[58] Field of Search ..... 430/504, 505, 506

[56] References Cited

U.S. PATENT DOCUMENTS 3,672,898 6/1972 Schwan et al. ..... 430/510

4,414,308 11/1983 Hamada ..... 430/505

*Primary Examiner*—Richard L. Schilling

*Attorney, Agent, or Firm*—Sughrue, Mion, Zinn, Macpeak & Seas

[57] ABSTRACT

A silver halide color photographic material is provided, having on a support, one or more cyan coupler-containing red-sensitive silver halide emulsion layers, magenta coupler-containing green-sensitive silver halide emulsion layers and yellow coupler-containing blue-sensitive silver halide emulsion layers and additionally having a silver halide emulsion layer which contains at least one cyan coupler and which is spectrally sensitized such that the relation of the maximum sensitivity wavelength $\lambda_{RG}$ of the spectral sensitivity distribution thereof to the weight averaged wavelength of sensitivity $\bar{\lambda}_R$ of the spectral sensitivity distribution of said red-sensitive layer and the weight averaged wavelength of sensitivity $\bar{\lambda}_G$ of the spectral sensitivity distribution of said green-sensitive layer satisfies the formulae $$\bar{\lambda}_R - \lambda_{RG} \geqq 5 \text{ nm}$$

and $$\bar{\lambda}_{RG} - \lambda_G \geqq 5 \text{ nm.}$$

The present photographic materials have high sensitivity and high and faithful color reproducibility.

24 Claims, 7 Drawing Figures

COLOR PHOTOGRAPHIC MATERIAL

FIELD OF THE INVENTION

The present invention relates to color photographic materials having high distinguishability of yellow, orange, and red colors and high color reproducibility of a violet color.

BACKGROUND OF THE INVENTION

Various means have heretofore been known to improve the color reproduction of color films in order to make the formed color image more faithful to an object and to enhance the sharpness of the formed color image. For instance, Japanese Patent Application (OPI) No. 2537/75 describes a method to use a DIR compound having an interlayer development inhibitory effect so as to make the reproduction of primary colors more highly pure and sharp (the term "OPI" as used herein refers to a "published unexamined Japanese patent application"). In addition, another means is known for masking the deterioration of color reproducibility which results from the unnecessary side absorption of a coloring dye of a coupler used in a color film, by the use of a colored coupler. However, said known means are still defective in that it has not been possible in the color reproduction of neutral tints such as orange color or violet color to be faithful to the original object, although the color reproducibility of primary colors such as blue, green, and red colors have been improved. On the other hand, U.S. Pat. No. 3,672,898 describes specific definitions of the spectral sensitivity distribution of each of blue, green- and red-sensitive layers so as to improve the faithfulness of the color reproduction. However, this method is difficult to be practically applied to photographic materials for cameras for the following reasons:

The first reason is, when the spectral sensitivity of a red-sensitive layer is shifted to the range of short wavelengths and is thereby made to substantially overlap with the spectral sensitivity distribution of a green-sensitive layer, the sensitivity of said red-sensitive layer decreases. This is one defect. Said red sensitivity reduction is caused by the fact that the amount of light in the side of a short wavelength in the red-sensitive layer becomes insufficient due to the optical absorption of a sensitizer dye used in a green-sensitive layer which generally exists in the upper layers of said red-sensitive layer and the fact that the red-sensitive layer itself contains a magenta colored cyan coupler so as to correct the side absorption of a green color light of a coloring dye of a cyan coupler contained in said red-sensitive layer and therefore the amount of light in the side of a short wavelength in said red-sensitive layer also becomes insufficient due to the optical absorption of said magenta colored cyan coupler contained therein. In particular, in the case that a phenol type cyan coupler as described in Japanese Patent Application (OPI) No. 42045/83 and Japanese Patent Application (OPI) No. 204545/82 is used, the use of a magenta colored cyan coupler is essential and indispensable as the coloring dye in said phenol type cyan coupler has a large amount of said side absorption, and thus, the sensitivity reduction of the red-sensitive layer is remarkable in said case.

The second reason is, when each spectral sensitivity is made largely overlapped with each other, the distinguishability of neutral tints is made high but the chroma of primary colors is made lowered. This is another defect. In order to compensate for said chroma reduction, the interlayer development inhibitory effect is necessary to be made large as mentioned above. In practice, however, any sufficient effect could not be attained therefor in a conventional technique, for various reasons, including, for example, problems of accumulation of a released inhibitor which will lead to fluctuation of the characteristics of light-sensitive materials finally obtained after processing.

The present inventors have earnestly tried various experiments in order to overcome said defects in prior arts, and have now found the present invention which is free from said defects, as described in detail hereinbelow.

SUMMARY OF THE INVENTION

A first object of the present invention is to provide a photographic material for camera capable of forming a color image with high color reproduction which is faithful to an object.

A second object of the present invention is to provide a photographic material capable of forming a color image with high color reproduction in which not only primary colors but also neutral tints in the formed color image are faithful to those of an object.

A third object of the present invention is to provide a photographic material having high sensitivity and high and faithful color reproducibility.

Accordingly, the present invention provides, in order to satisfy said objects, a silver halide color photographic material having, on a support, one or more cyan coupler-containing red-sensitive silver halide emulsion layers, magenta coupler-containing green-sensitive silver halide emulsion layers and yellow coupler-containing blue-sensitive silver halide emulsion layers and additionally having a silver halide emulsion layer (hereinafter referred to as a red- and green-sensitive layer) which contains at least one cyan coupler and which is spectrally sensitized such that the relation of the maximum sensitivity wavelength $\lambda_{RG}$ of the spectral sensitivity distribution thereof to the weight averaged wavelength of sensitivity $\bar{\lambda}_R$ of the spectral sensitivity distribution of said red-sensitive layer and the weight average wavelength of sensitivity $\bar{\lambda}_G$ of the spectral sensitivity distribution of said green-sensitive layer satisfy the following formulae $$\bar{\lambda}_R - \lambda_{RG} \geqq 5 \text{ nm}$$

and $$\lambda_{RG} - \bar{\lambda}_G \geqq 5 \text{ nm.}$$

DETAILED DESCRIPTION OF THE INVENTION

Figure 1A:
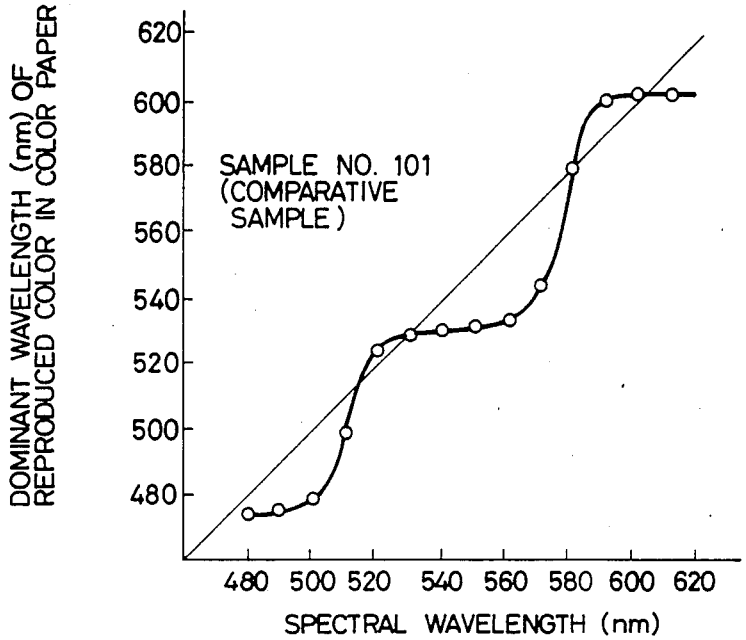
FIGS. 1A to 1G each represents a graph showing the results of color reproduction tests on photographic light-sensitive materials. The horizontal axes indicate the transmission optimum of interference spectrum used for exposure, while the vertical lines indicate dominant wavelength of reproduced color in color paper. The solid lines indicate ideal relation.

The weight average wavelength of sensitivity of a spectral sensitivity distribution is obtained by the following formula $$\bar{\lambda} = \frac{\int_{400}^{700} \lambda S(\lambda) d\lambda}{\int_{400}^{700} S(\lambda) d\lambda}$$

In said formula, S(λ) refers to the spectral sensitivity distribution.

The weight averaged wavelength of sensitivity of $\bar{\lambda}_B$, $\bar{\lambda}_G$, and $\bar{\lambda}_R$ of the spectral sensitivity distribution of each of blue-sensitive layer, green-sensitive layer and red-sensitive layer, respectively, in the photographic material of the present invention preferably fails within the following range.

$$420 \text{ nm} \leqq \bar{\lambda}_B \leqq 470 \text{ nm}$$

$$520 \text{ nm} \leqq \bar{\lambda}_G \leqq 560 \text{ nm}$$

$$600 \text{ nm} \leqq \bar{\lambda}_R \leqq 670 \text{ nm}.$$

In the photographic material of the present invention, the interlayer effect is preferably large, and therefore, it is preferred to incorporate a DIR compound capable of releasing a highly diffusible development inhibitor as having a degree of diffusibility of 0.4 or more, as described in European Pat. No. 101,621, in the blue-sensitive layers, green-sensitive layers and red-sensitive layers of the present photographic material. The cyan coupler and magenta coupler, the latter being optionally co-used together with the former, contained in the silver halide emulsion layer (red- and green-sensitive layer) which has the weight averaged wavelength of sensitivity $\bar{\lambda}_{RG}$ of a spectral sensitivity distribution may be either a colored coupler or a DIR coupler. In addition, said red- and green-sensitive layer may further contain a yellow coupler, provided that the yellow coupler does not hinder the color reproduction of the material. The red- and green-sensitive layer may be incorporated in any position of the photographic layers of the photographic material of the present invention, and is preferably positioned remoter from a support than a red-sensitive layer, and more preferably remoter therefrom than both red-sensitive layer and green-sensitive layer.

Compounds capable of forming a highly diffusible development inhibitor or a precursor thereof, which may effectively be used in the present invention, are those which may release said development inhibitor or precursor thereof during coupling with a color developer, and are represented by formula (I)

$$J\text{-}(Y)_h \qquad \text{(I)}$$

wherein J represents a coupler component, h is 1 or 2; and Y represents a highly diffusible development inhibitor or a compound capable of releasing said development inhibitor, which is bonded with said coupler component J at its coupling position and which may be released therefrom by the reaction with an oxidized form of a color developing agent, said development inhibitor preferably having a degree of diffusibility of 0.4 or more, as measured by a method described hereinbelow.

In said formula (I), Y preferably represents a group selected from formulae (II) to (V).

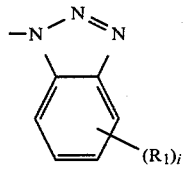
(II)

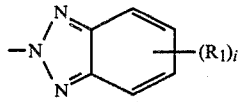
(III)

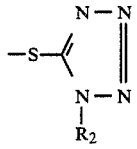
(IV)

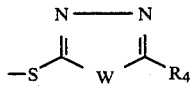
(V)

In the above formulae, W represents —S— or —N($R_3$)—; $R_1$, $R_2$, $R_3$ and $R_4$ each represents a substituent which is selected such that each compound may have a degree of diffusibility of 0.4 or more; and i is an integer of 1 to 4, preferably 1 or 2.

Substituents that can be selected for said $R_1$ to $R_4$ are described below in detail. When i is 2 to 4, $R_1$'s may be the same or different. $R_1$ includes $CH_3$— (with the proviso that i=2), Br— (i=1; all of the following are the same), —NHCOR', —$NHSO_2R'$, —OR', —R',

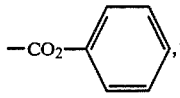

—$CO_2R'$. Of these,

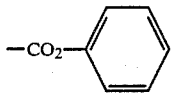

and —$CO_2R'$ are preferred. In said substituents, R' represents a substituted or unsubstituted linear, cyclic, or branched aliphatic group.

Typical examples of the aliphatic group represented by R' include an alkyl group and an alkenyl group, and more specifically a linear, cyclic or branched alkyl group having 1 to 10 carbon atoms, preferably 1 to 5 carbon atoms, and a linear, cyclic or branched alkenyl group having 1 to 10 carbon atoms, preferably 1 to 5 carbon atoms. The alkyl and alkenyl groups may be unsubstituted or substituted with one or more substituents. Examples of the substituents include a halogen atom, a nitro group, an alkoxy group having 1 to 4 carbon atoms, an aryloxy group having 6 to 10 carbon atoms, an alkanesulfonyl group having 1 to 4 carbon atoms, an arylsulfonyl group having 6 to 10 carbon atoms, an alkanamido group having 1 to 5 carbon atoms, an anilino group, a benzamido group, an alkylcarbamoyl group having 1 to 6 carbon atoms, a carbamoyl group, an arylcarbamoyl group having 6 to 10 carbon atoms, an alkylsulfonamido group having 1 to 4 carbon atoms, an arylsulfonamido group having 6 to 10 carbon atoms, an alkylthio group having 1 to 4 carbon atoms, an arylthio group having 6 to 10 carbon atoms, a phthalimido group, a succinimido group, an imidazolyl group, a 1,2,4-triazolyl group, a pyrazolyl group, a benzotriazolyl group, a furyl group, a benzothiazolyl group, an alkylamino group having 1 to 4 carbon atoms, an alkanoyl group having 1 to 4 carbon atoms, a benzoyl group, an alkanoyloxy group having 1 to 4 carbon atoms, a benzoyloxy group, a perfluoroalkyl group having 1 to 4 carbon atoms, a cyano group, a tetrazolyl group, a hydroxy group, a carboxyl group, a mercapto group, a sulfo group, an amino group, a sulfamoyl group, an alkylsulfamoyl group having 1 to 4 carbon atoms, an arylsulfamoyl group having 6 to 10 carbon atoms, a morpholino group, an aryl group having 6 to 10 carbon atoms, a pyrrolidinyl group, a ureido group, a urethane group, an alkoxycarbonyl group having 1 to 6 carbon atoms, an aryloxycarbonyl group having 6 to 10 carbon atoms, an imidazolinyl group, an alkylideneamino group having 1 to 6 carbon atoms, etc.

$R_2$ includes an ethyl group, a propyl group, a hydroxy-substituted phenyl group, an amino-substituted phenyl group, a sulfamoyl-substituted phenyl group, a carboxy-substituted phenyl group, a methoxycarbonyl-substituted phenyl group, a 3-methoxyphenyl group, $-(CH_2)_2COOR'$, $-(CH_2)_3COOR'$,

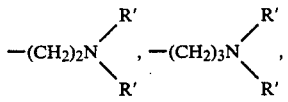

(two R's may be the same or different), $-(CH_2)_2OCH_3$, a 3-carbamoylphenyl group or a 3-ureidophenyl group. Of these, $-(CH_2)_{2-3}COOR'$ is preferred. In said substituents, R' has the same meaning as in the above described $R_1$.

$R_3$ includes, for example, a hydrogen atom or an alkyl group having 1 to 4 carbon atoms such as methyl, ethyl, propyl and butyl; and $R_4$ includes, for example, an amino group, $-NHCOR'$,

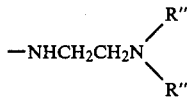

(R''s may be the same or different and each represents $-(CH_2)_2SO_3H$, $-(CH_2)_3SO_3H$ or $-(CH_2)_4SO_3H$). In said substituents, R' has the same meaning as in the above described $R_1$.

The diffusibility of a development inhibitor is evaluated according to the method described at column 8 lines 10–67 of U.S. Pat. No. 4,500,634 as follows:

The following first and second layers are coated on a transparent support to form a two layer constitutional photographic material (Sample B).

FIRST LAYER

Red-Sensitive Silver Halide Emulsion Layer

A gelatin-coating solution containing a red sensitized emulsion, which comprises a silver bromoiodide emulsion (silver iodide: 5 mol%, average size: 0.4 μm) and $6\times10^{-5}$ mol (on the basis of 1 mol of silver) of a Sensitizer Dye P-2 of the Example and 0.0015 mol (on the basis of 1 mol of silver) of a Coupler X was coated in an amount of 1.8 g (coated silver amount)/$m^2$. Film thickness: 2 μm.

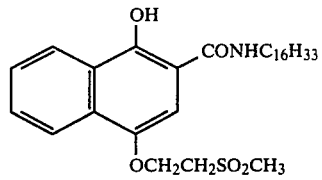

Coupler X

SECOND LAYER

A gelatin layer comprising the silver bromoiodide emulsion as used in said first layer (but not red sensitized) and polymethyl methacrylate particles (diameter: about 1.5 μm). Coated silver amount: 2 g/$m^2$. Film thickness: 1.5 μm.

Each layer contained, in addition to said components, a gelatin hardener or a surfactant.

In the same manner as in the preparation of said Sample B, another sample (Sample A) was formed comprising the same consittution as Sample B, with the exception that the second layer did not contain said silver bromoiodide emulsion.

The above formed Samples A and B were subjected to sensitometric exposure and then treated in the same manner as in the Example, with the exception that the development time was 2 minutes and 10 seconds. A development inhibitor was added to the developer solution until the density of Sample A became lowered to ½, whereupon the decrement of the density of Sample B was measured, and the degree of the decrement of the density of Sample B on said point was a criterion of the diffusibility of the development inhibitor in a silver halide emulsion film.

In the above described general formula (I), Y may further represent the following formula (VI)

$$-\text{TIME}-\text{INHIBIT} \qquad \text{(VI)}$$

wherein "TIME" represents a group which is bonded with a coupler in its coupling position and which may be cleaved by the reaction with a color developing agent, and this group can appropriately control and release the group "INHIBIT", after being cleaved off from a coupler; and "INHIBIT" represents a development inhibitor.

Preferred examples of said "TIME" are those of formulae (VII) to (XIII) as described in U.S. Pat. No. 4,500,634 corresponding to European Pat. No. 101,621.

In formula (I), a yellow color image forming coupler residue represented by J includes a pivaloylacetanilide type, benzoylacetanilide type, malondiester type, malondiamide type, dibenzoylmethane type, benzothiazolylacetamide type, malonester-monoamide type, benzothiazolyl-acetate type, benzoxazolylacetamide type, benzoxazolyl-acetate type, malondiester type, benzimidazolylacetamide type or benzimidazolyl-acetate type coupler residue; a coupler residue derived from a heterocyclic ring-substituted acetamide or heterocyclic ring-substituted acetate, as described in U.S. Pat. No. 3,841,880; a coupler residue derived from an acylacetamide, as described in U.S. Pat. No. 3,770,446, British Pat. No. 1,459,171, German Patent Application (OLS) No. 2,503,099, Japanese Patent Application (OPI) No. 139738/75, or *Research Disclosure,* RD No. 15737 (May, 1977); or a heterocyclic type coupler residue as described in U.S. Pat. No. 4,046,574.

A magenta color image forming coupler residue represented by J includes a coupler residue containing a 5-oxo-2-pyrazoline nucleus, pyrazolo[1,5-a]benzimidazole nucleus or cyanoacetophenone type coupler residue, and said coupler residues are preferred.

A cyan color image forming coupler residue represented by J preferably includes a phenol nucleus- or α-naphthol nucleus-containing coupler residue.

In addition, even if said coupler does not form any substantial dye, after coupled with an oxidized form of a developing agent and released a development inhibitor, said coupler still is effective as a DIR coupler and may be used as a DIR coupler in the present invention. Examples of said type of a coupler residue represented by J are those as described in U.S. Pat. Nos. 4,052,213, 4,088,491, 3,632,345, 3,958,993 and 3,961,959.

Preferred examples of J in the formula (I) are those of formulae (IA) to (IXA) as described in European Pat. No. 101,621.

In particular, preferred compounds are those of Nos. (D-1) through (D-47) as described in said patent specification.

In order to impart a desired spectral sensitivity distribution to each of green-sensitive, blue-sensitive and red-sensitive photographic emulsion layers of the photographic material of the present invention, a known sensitizer dye such as a methine dye or the like may optionally and freely be co-used in said layers. Sensitizer dyes which may be used for said spectral sensitization include cyanine dyes, merocyanine dyes, complex cyanine dyes, complex merocyanine dyes, holopolar cyanine dyes, hemicyanine dyes, styryl dyes and hemioxonol dyes. Especially preferred dyes are cyanine dyes, merocyanine dyes and complex merocyanine dyes. These dyes may contain any and every conventional basic heterocyclic nucleus, which is generally contained in conventional cyanine dyes, including pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus, etc.; alicyclic hydrocarbon ring-fused nuclei of said nuclei; and aromatic hydrocarbon ring-fused nuclei of said nuclei, such as indolenine nucleus, benzindolenine nucleus, indole nucleus, benzoxazole nucleus, naphthoxazole nucleus, benzothiazole nucleus, naphthothiazole nucleus, benzoselenazole nucleus, benzimidazole nucleus, quinoline nucleus, etc. These nuclei may optionally have substituent(s) on their carbon atom(s).

Morocyanine dyes and complex merocyanine dyes may contain a ketomethylene structural nucleus, such as a 5- or 6-membered heterocyclic nucleus of pyrazolin-5-one nucleus, thiohydantoin nucleus, 2-thiooxazolidine-2,4-dione nucleus, thiazolidine-2,4-dione nucleus, rhodanine nucleus, thiobarbituric acid nuclei, etc.

Said sensitizer dyes may be used singly, or may be used in the form of a combination of two or more of said sensitizer dyes. The combination use of said sensitizer dyes is often utilized for the purpose of supersensitization.

Any silver halide of silver bromide, silver bromoiodide, silver bromochloroiodide, silver bromochloride and silver chloride may be used in the photographic emulsion layers of the photographic material of the present invention. Preferred silver halides among them are silver bromoiodide or silver bromochloroiodide containing 30 mol% or less silver iodide. Especially preferred halide is silver bromoiodide containing from 2 mol% to 25 mol% of silver iodide.

Silver halide particles contained in the photographic material of the present invention may be so-called regular particles having a cubic, octahedral, tetradecahedral, or the like regular crystalline forms, or irregular particles having an irregular crystalline form such as spherical particles, or other crystal particles having a twin plane or the like crystal defect, or composite crystals comprising the combination of said crystal forms.

Regarding the grain size of the silver halide particles, these may be fine particles having a grain size of 0.1 μm or less or may be large particles having a projected area diameter of up to 10 μm; and these silver halide particles may be in the form of a monodisperse system emulsion having a narrow particle distribution or may be in the form of a polydisperse system emulsion having a wide distribution.

Photographic emulsions to be used in the present invention may be prepared according to known methods, for example, as described in P. Glafkides: *Chimie et Physique Photographique,* Paul Montel (1967); G. F. Duffin: *Photographic Emulsion Chemistry,* Focal Press (1966); Zelikman et al.: *Making and Coating Photographic Emulsion,* Focal Press (1964), etc. For instance, an acid method, a neutral method or an ammonia method may be used for the formation of silver halide emulsions. For the reaction of a soluble silver salt and a soluble halogen salt, any of a single jet mixing method or a double jet mixing method, or a combination thereof, may be used. In addition, a so-called reverse mixing method where silver halide particles are formed in the presence of an excess silver ion may also be used. Further, a so-called controlled double jet method which is one type of said double jet mixing method may also be used, where the pAg value in the liquid phase in which silver halide is formed is kept constant. According to this method, an emulsion containing silver halide particles which have a regular crystal form and a uniform grain size distribution may be obtained.

Two or more silver halide emulsions which have been prepared separately may be used in the present invention, as blended.

The above described silver halide emulsion containing regular halide particles may be obtained by controlling the pAg value and the pH value during the formation of said particles. Details therefor are described, say, in *Photographic Science and Engineering,* Vol. 6, pp. 159–165 (1962); *Journal of Photographic Science,* Vol. 12, pp. 242–251 (1964); U.S. Pat. No. 3,655,394 and British Pat. No. 1,413,748.

Details of monodisperse system emulsions are described, e.g., in Japanese Patent Application (OPI) Nos. 8600/73, 39027/76, 83097/76, 137133/78, 48521/79, 99419/79, 37635/83, 49938/83, Japanese Patent Publication No. 11386/72, U.S. Pat. No. 3,655,394, British Pat. No. 1,413,748, etc.

In addition, plate-like (also sometimes referred to as tabular) particles having an aspect ratio of 5/1 or more may also be used in the present invention. Said plate-like particles may easily be obtained according to various methods, e.g., as described in Cleve: *Photography Theory and Practice,* p. 131 (1930); Gutoff: *Photographic Science and Engineering,* Vol. 14, pp. 248 to 257 (1970); U.S. Pat. Nos. 4,434,226, 4,414,310 and 4,433,048, British Pat. No. 2,112,157, etc. The use of said plate-like particles in the photographic material of the present invention is advantageous, as providing various merits that the coatability of the emulsion layer is made high and that the color sensitizability of the used sensitizer dye is also made high, which are described in detail in the above cited U.S. Pat. No. 4,434,226.

The crystal structure of silver halide particles may be uniform, or otherwise, the inner part and the outer part of said particles may comprise different halogen compositions, or said particles may have a flaky structure. Various structures of silver halide particles are described, e.g., in British Pat. No. 1,027,146, U.S. Pat. Nos. 3,505,068 and 4,444,877 and Japanese Patent Application No. 248469/83. In addition, silver halide particles having different compositions may be bound by epitaxial binding, or said particles may be bound with any other compound such as silver rhodanide, lead oxide, etc. These emulsion particles are described, e.g., in U.S. Pat. Nos. 4,094,684, 4,142,900 and 4,459,353, British Pat. No. 2,038,792, U.S. Pat. Nos. 4,349,622, 4,395,478, 4,433,501, 4,463,087, 3,656,962 and 3,852,067, Japanese Patent Application (OPI) No. 162540/84, etc.

In addition, a mixture of silver halide particles having various different crystal structures may also be used in the photographic material of the present invention.

A silver halide solvent is useful for acceleration of ripening. For instance, it is known to put an excess amount of a halogen ion in a reaction chamber for the purpose of acceleration of ripening. Accordingly, it is apparent that the ripening may be accelerated merely by introducing a halide salt solution into a reaction chamber. In addition, any other ripening agent may be used, and the total amount of said ripening agent may previously be incorporated in a dispersion medium put in a reaction chamber prior to the addition of silver and halide salts thereto, or alternatively, may be introduced into a reaction chamber together with the addition of one or more halide salts or silver salts or a peptizer. Still another embodiment is to introduce said ripening agent into a reaction system independently, in the stage of the addition of a halide salt or a silver salt thereto.

Other ripening agents than a halogen ion which may be used in the present invention are ammonia or amine compounds and thiocyanate salts such as alkali metal thiocyanates, especially sodium or potassium thiocyanates and ammonium thiocyanates. The use of thiocyanate ripening agents is suggested in U.S. Pat. Nos. 2,222,264, 2,448,534 and 3,320,069. In addition, conventional thioether ripening agents may also be used, which are described in U.S. Pat. Nos. 3,271,157, 3,574,628 and 3,737,313. Further, thione compounds as described in Japanese Patent Application (OPI) Nos. 82408/78 and 144319/78 may also be used.

The property of silver halide particles may be controlled by the existence of various compounds in the process of the formation of said silver halide. Said additive compounds may initially be put in a reaction chamber, or may be added thereto together with the addition of one or more salts thereto in conventional means. For instance, a compound of copper, iridium, lead, bismuth, cadmium, zinc, a chalcogen (such as sulfur, selenium or tellurium), gold or a VII group noble metal may be incorporated in the reaction system during the formation procedure of a silver halide precipitate, whereby the characteristics of the formed silver halide may well be controlled, as described in U.S. Pat. Nos. 2,448,060, 2,628,167, 3,737,313 and 3,772,031 and *Research Disclosure,* Vol. 134 (June, 1975, No. 13452). In addition, the inner part of particles of a silver halide emulsion may be subjected to reduction sensitization during the formation of the precipitate of said particles, as described in Japanese Patent Publication No. 1410/83 and Moisar et al.: *Journal of Photographic Science,* Vol. 25, pp. 19–27 (1977).

Silver halide particles are generally chemically sensitized. The chemical sensitization may be carried out by the use of an active gelatin, as described in T. H. James: *The Theory of the Photographic Process,* 4th Ed., Macmillan, pp. 67–76 (1977); or otherwise may be carried out by the use of a sensitizer such as sulfur, selenium, tellurium, gold, platinum, palladium or iridium or a mixture of two or more thereof in a reaction system having a pAg value of from 5 to 10 and a pH value of from 5 to 8 at a temperature of from 30° to 80° C., as described, e.g., in *Research Disclosure* (Vol. 120, April, 1974, No. 12008); *Research Disclosure* (Vol. 34, June, 1975, No. 13452); U.S. Pat. Nos. 2,642,361, 3,297,446, 3,772,031, 3,857,711, 3,901,714, 4,266,018 and 3,904,415, and British Pat. No. 1,315,755. Said chemical sensitization is most preferably carried out in the presence of a gold compound and a thiocyanate compound, or in the presence of a sulfur-containing compound as described in U.S. Pat. Nos. 3,857,711, 4,266,018 and 4,054,457, or a sulfur-containing compound such as a hypo compound, a thiourea compound or a rhodanine compound. The chemical sensitization may be carried out in the presence of a chemical sensitization auxiliary agent. Chemical sensitization auxiliary agents which may be used in the present invention include compounds which are known as capable of inhibiting a fog during the step of chemical sensitization and increasing the sensitivity of the photographic material, for example, azaindene, azapyrimidine compounds. Examples of chemical sensitization auxiliary agent-modifying agents are described in U.S. Pat. Nos. 2,131,038, 3,411,914 and 3,554,757, Japanese Patent Application (OPI) No. 126526/83, and the above cited *Photographic Emulsion Chemistry* (written by Duffin, pp. 138–143). In addition to said chemical sensitization or alternatively thereto, various reduction sensitization may be carried out, for example, by the use of a hydrogen as described in U.S. Pat. Nos. 3,891,446 and 3,984,249; or by the use of a reducing agent such as stannous chloride, thiuram dioxide or a polymine or by low pAg (e.g., less than 5) treatment and/or high pH (e.g., more than 8) treatment, as described in U.S. Pat. Nos. 2,518,698, 2,743,182 and 2,743,183. In addition, the color sensitivity of the present photographic material may be improved by chemical sensitization as described in U.S. Pat. Nos. 3,917,485 and 3,966,476.

In the present invention, various kinds of color couplers may be used, and typical examples are cyan, magenta, and yellow dye forming couplers, as described in various patent specifications which are referred to in *Research Disclosure* (December, 1978, No. 17643, VII-D) and (November, 1979, No. 18717). These couplers are preferably nondiffusible, as containing a ballast group or in the form of a dimer or higher polymer, and may be 4-equivalent or 2-equivalent. Other couplers capable of improving the granularity of a photographic emulsion due to the diffusion of the formed dye may also be used.

Preferred yellow couplers in the present invention are α-pivaloyl or α-benzoylacetanilide type couplers capable of splitting at an oxygen atom or a nitrogen atom.

Especially preferred examples of said 2-equivalent couplers are yellow couplers splittable at oxygen atom as described, e.g., in U.S. Pat. Nos. 3,408,194, 3,447,928, 3,933,501 and 4,022,620, and yellow couplers splittable at nitrogen atom as described, e.g., in U.S. Pat. Nos. 3,973,968 and 4,314,023, Japanese Patent Publication No. 10739/83, Japanese Patent Application (OPI) No. 132926/75, German Patent Application (OLS) Nos. 2,219,917, 2,261,361, 2,329,587 and 2,433,812.

Magenta couplers which are preferably used in the present invention include 5-pyrazolone type couplers, pyrazolo[5,1-c]-1,2,4-triazoles as described in U.S. Pat. No. 3,725,067 and pyrazolo[1,5-b]-1,2,4-triazoles as described in European Pat. No. 119,860. Other magenta couplers which are 2-equivalent with a removable group as bound at a coupling active position via a nitrogen atom or a sulfur atom are also preferred.

As for cyan couplers, those which are fast to humidity and temperature are preferably used in the present invention, and typical examples thereof are phenol type couplers as described in U.S. Pat. No. 3,772,002; 2,5-diacylaminophenol type couplers as described in Japanese Patent Application (OPI) Nos. 31953/84, 166956/84 and 24547/85; phenol type couplers containing a phenylureido group in 2-position and an acylamino group in 5-position, as described in U.S. Pat. No. 4,333,999; and naphthol type couplers as described in Japanese Patent Application No. 93605/84.

A yellow or magenta colored coupler may be co-used in order to correct any unnecessary side abosrption existing to the short wavelength side of the main absorption of a coloring dye. Said coupler is used, in general, dispersed and emulsified in an aqueous medium of a high boiling point organic solvent such as a phthalic acid ester or phosphoric acid ester having 16 to 32 carbon atoms optionally together with any other organic solvent such as ethyl acetate. Regarding the standard amount of the color coupler to be used in the present invention, the yellow coupler is generally used in an amount of from 0.01 to 0.5 mol, the magenta coupler is generally used in an amount of from 0.003 to 0.3 mol and the cyan coupler is generally used in an amount of from 0.002 to 0.3 mol, each on the basis of 1 mol of the photographic silver halide used.

A conventional antifogging agent or stabilizer may be used for the purpose of prevention of fog during preparation, preservation or photographic treatment of a photographic material or of stabilization of the property of said material. Examples of said additives and the use thereof are described, e.g., in U.S. Pat. Nos. 3,954,474 and 3,982,947, Japanese Patent Publication No. 28660/77, *Research Disclosure* (No. 17643, December, 1978, VIA-VIM), and *Stabilization of Photographic Silver Halide Emulsions,* by E. J. Barr, published by Focal Press, 1974.

The photographic material of the present invention may contain, as a color fogging inhibitor or a color stain inhibitor, a hydroquinone compound, an aminophenol compound or a sulfonamido-phenol compound, etc. In addition, the photographic material of the present invention may contain various kinds of a color deterioration inhibitor, for example, an organic inhibitor such as a 5-hydroxycoumaran compound or a spirocoumaran compound or a metal complex type inhibitor such as a bis-N,N-dialkyldithiocarbamato-nickel complex.

The photographic material of the present invention may contain an ultraviolet absorbent such as a benzotriazole compound. Examples thereof are described e.g., in *Research Disclosure,* RD No. 24239 (June, 1984). The present photographic material may further contain a water-soluble dye in a hydrophilic colloid layer, as a filter dye or for the purpose of prevention of irradiation or halation or for some other purposes.

As a binder in a photosensitive layer or a backing layer in the photographic material of the present invention, a gelatin, a modified gelatin or a synthetic hydrophilic polymer may be used. In addition, a hardener such as a vinylsulfone derivative may be incorporated in any hydrophilic colloid layer, and further, a vinyl polymer having a sulfinate salt in its side chain may be used as a hardening promoter.

The photographic material of the present invention may contain one or more surfacants for the purpose of coating assistance, static charge prevention, slidability improvement, emulsification and dispersion, anti-blocking and improvement of photographic characteristics (such as development acceleration, contrast enhancement, sensitization).

The photographic material of the present invention may further contain, in addition to the above described additives, various kinds of a stabilizer, a stain inhibitor, a developing agent or a precursor thereof, a development promoter or a precursor thereof, a lubricating oil, a matting agent, a mordant agent, an antistatic agent, a plasticizer or other additives which are useful in conventional photographic materials. Examples of said additives are described, e.g., in *Research Disclosure,* No. 17643, December, 1978 and No. 18716, November, 1979.

The present invention may preferably be applied to a color film for camera of high sensitivity having on a support at least two emulsion layers of the same color of different sensitivity. The order of a typical layer arrangement of the present photographic material is red-sensitive layer/green-sensitive layer/blue-sensitive layer. Otherwise, the present photographic material may have an inverse layer arrangement in which a high sensitive layer is sandwiched between emulsion layers of different color sensitivity.

The photographic material of the present invention is, after treated with a developer comprising a main component of an aromatic primary amine type developing agent, subjected to bleaching and fixation or bleach-fixation or a combination of said treatments so as to remove the developed silver. A bleaching promoter may optionally be used in said process, such as an iodine ion, a thiourea compound or a thiol compound. After the bleach-fixation or fixation, the photographic material is in many cases washed with water, and a countercurrent water washing using two or more water tanks is preferred therefor, as the amount of water to be used may thereby be economized. A multistage countercurrent stabilization treatment may be imparted to the material, as described in Japanese Patent Application (OPI) No. 8543/82. For this treatment, a pH regulating buffer or formalin may be used. In particular, an ammonium salt is preferred as an additive.

The present invention is explained in greater detail by reference to the following Example, which is not intended to be interpreted as limiting the scope of the present invention.

EXAMPLE

Sample No. 101 (comparative sample)

Plural layers (as set forth below) were coated on a cellulose triacetate film support to form Multilayer Color Photographic Material No. 101.

| | |
|---|---|
| First Layer: Antihalation Layer | |
| Black colloidal silver | 0.2 g (silver)/$m^2$ |
| Gelatin | 1.3 g/$m^2$ |
| UV-1 (ultraviolet absorbent) | 0.1 g/$m^2$ |
| UV-2 (ultraviolet absorbent) | 0.2 g/$m^2$ |
| OIL-1 (oil for dispersion) | 0.01 g/$m^2$ |
| OIL-2 (oil for dispersion) | 0.01 g/$m^2$ |
| Second Layer: Intermediate Layer | |
| Silver halide fine particles (AgBr having an average grain size of 0.07 μm) | 0.15 g (silver)/$m^2$ |
| Gelatin | 1.0 g/$m^2$ |
| C-1 (colored coupler) | 0.1 g/$m^2$ |
| C-2 (colored coupler) | 0.01 g/$m^2$ |
| OIL-1 | 0.1 g/$m^2$ |
| Third Layer: First Red-Sensitive Layer | |
| Silver bromoiodide emulsion (AgBrI having an average grain size of 0.3 μm and silver iodide of 3 mol %) | 1.5 g (silver)/$m^2$ |
| Gelatin | 1.5 g/$m^2$ |
| P-1 (sensitizer dye) | $4.5 \times 10^{-4}$ mol per mol of silver |
| P-2 (sensitizer dye) | $1.5 \times 10^{-4}$ mol per mol of silver |
| C-3 (coupler) | 0.5 g/$m^2$ |
| C-4 (DIR coupler) | 0.20 g/$m^2$ |
| C-2 | 0.03 g/$m^2$ |
| OIL-1 | 0.12 g/$m^2$ |
| OIL-2 | 0.12 g/$m^2$ |
| Fourth Layer: Second Red-Sensitive Layer | |
| Silver bromoiodide emulsion (AgBrI having an average grain size of 0.7 μm and silver iodide of 6 mol %) | 1.0 g (silver)/$m^2$ |
| Gelatin | 1.0 g/$m^2$ |
| P-1 | $3 \times 10^{-4}$ mol per mol of silver |
| P-2 | $1 \times 10^{-4}$ mol per mol of silver |
| C-5 (coupler) | 0.07 g/$m^2$ |
| C-2 | 0.01 g/$m^2$ |
| OIL-1 | 0.01 g/$m^2$ |
| OIL-2 | 0.01 g/$m^2$ |
| Fifth Layer: Intermediate Layer | |
| Gelatin | 1 g/$m^2$ |
| C-6 | 0.03 g/$m^2$ |
| OIL-1 | 0.05 g/$m^2$ |
| OIL-2 | 0.05 g/$m^2$ |
| Sixth Layer: First Green-Sensitive Layer | |
| Silver bromoiodide emulsion (AgBrI having an average grain size of 0.3 μm and silver iodide of 4 mol %) | 0.08 g (silver)/$m^2$ |
| Gelatin | 1.0 g/$m^2$ |
| O-1 (sensitizer dye) | $5 \times 10^{-4}$ mol per mol of silver |
| O-2 (sensitizer dye) | $2 \times 10^{-4}$ mol per mol of silver |
| C-7 (coupler) | 0.4 g/$m^2$ |
| C-8 (DIR coupler) | 0.06 g/$m^2$ |
| C-1 | 0.15 g/$m^2$ |
| OIL-1 | 0.5 g/$m^2$ |
| Seventh Layer: Second Green-Sensitive Layer | |
| Silver bromoiodide emulsion (AgBrI having an average grain size of 0.7 μm and silver iodide of 6 mol %) | 1.0 g (silver)/$m^2$ |
| Gelatin | 1.0 g/$m^2$ |
| O-1 | $3.5 \times 10^{-4}$ mol per mol of silver |
| O-2 | $1.4 \times 10^{-4}$ mol per mol of silver |
| C-7 | 0.08 g/$m^2$ |
| C-1 | 0.02 g/$m^2$ |
| OIL-1 | 0.10 g/$m^2$ |
| Eighth Layer: Yellow Filter Layer | |
| Yellow colloidal silver | 0.04 g (silver)/$m^2$ |
| Gelatin | 1.0 g/$m^2$ |
| C-6 | 0.1 g/$m^2$ |
| OIL-1 | 0.3 g/$m^2$ |
| Ninth Layer: First Blue-Sensitive Layer | |
| Silver bromoiodide emulsion (AgBrI having an average grain size of 0.3 μm and silver iodide of 4 mol %) | 0.5 g (silver)/$m^2$ |
| Gelatin | 1.0 g/$m^2$ |
| O-3 (sensitizer dye) | $2 \times 10^{-4}$ mol per mol of silver |
| C-9 (coupler) | 0.7 g/$m^2$ |
| C-10 (DIR coupler) | 0.07 g/$m^2$ |
| OIL-1 | 0.2 g/$m^2$ |
| Tenth Layer: Second Blue-Sensitive Layer | |
| Silver bromoiodide emulsion (AgBrI having an average grain size of 1.5 μm and silver iodide of 10 mol %) | 0.5 g (silver)/$m^2$ |
| Gelatin | 0.6 g/$m^2$ |
| O-3 | $1 \times 10^{-4}$ mol per mol of silver |
| C-9 | 0.25 g/$m^2$ |
| OIL-1 | 0.07 g/$m^2$ |
| Eleventh Layer: First Protective Layer | |
| Gelatin | 1.5 g/$m^2$ |
| UV-1 | 0.1 g/$m^2$ |
| UV-2 | 0.2 g/$m^2$ |
| OIL-1 | 0.01 g/$m^2$ |
| OIL-2 | 0.01 g/$m^2$ |
| Twelfth Layer: Second Protective Layer | |
| Silver halide fine particles (AgBr having an average grain size of 0.07 μm) | 0.5 g (silver)/$m^2$ |
| Polymethyl methacrylate particles (having a diameter of about 1.5 μm) | 0.2 g/$m^2$ |
| H-1 (hardener) | 0.4 g/$m^2$ |
| S-1 (formaldehyde scavenger) | 0.5 g/$m^2$ |

C-1
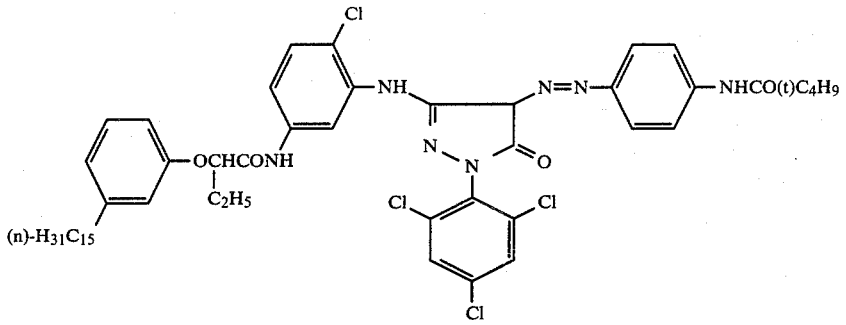
C-2
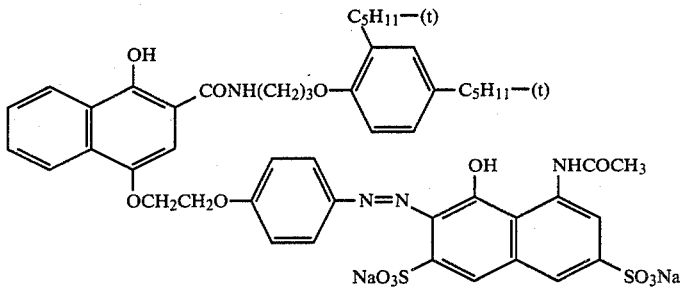
C-3
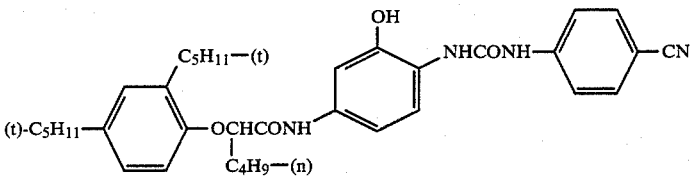
C-4
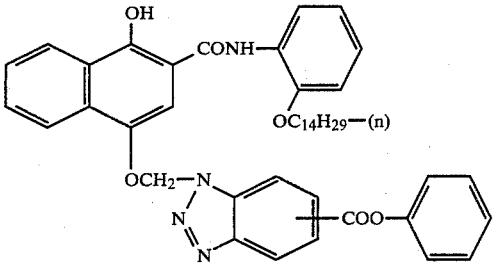
C-5
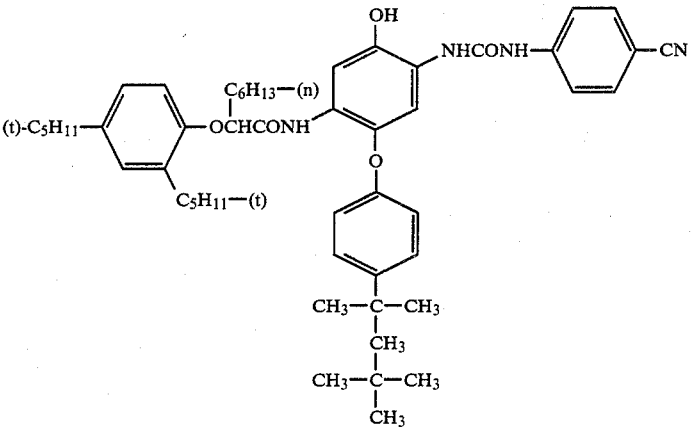
2,5-Di-t-pentadecylhydroquinone C-6

-continued
C-7
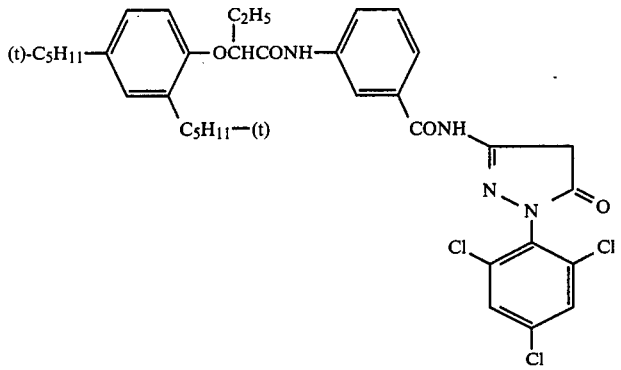
C-8
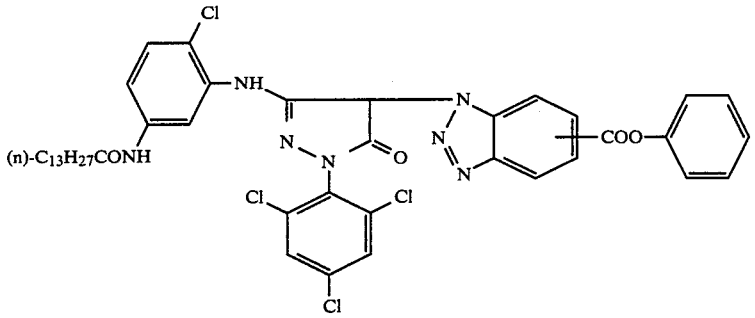
C-9
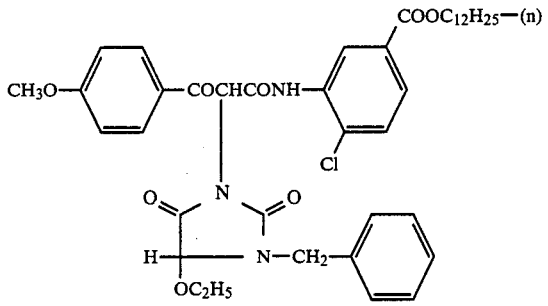
C-10
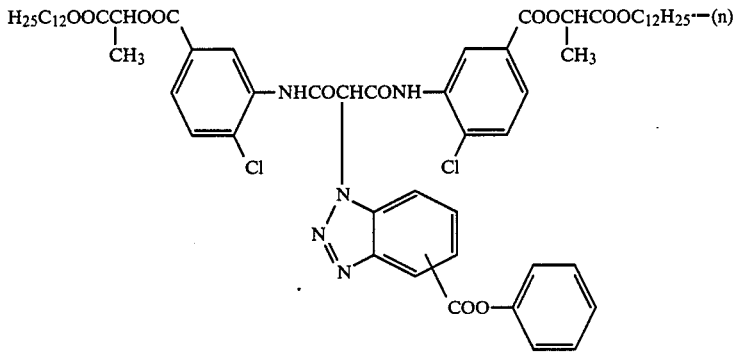

-continued
C-11
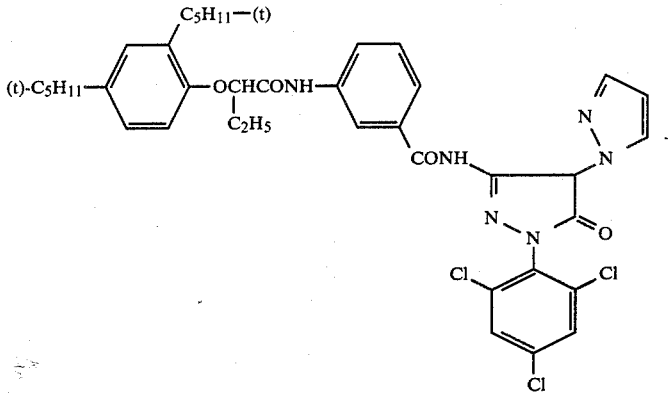
P-1
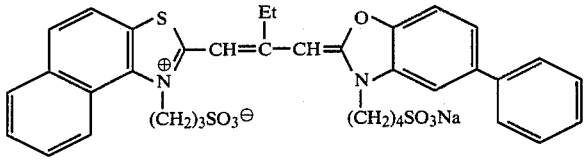
P-2
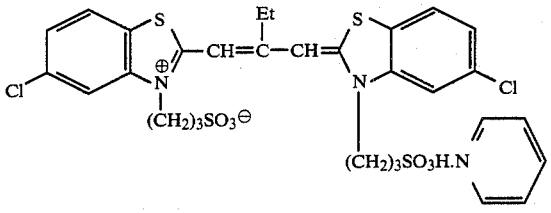
O-1
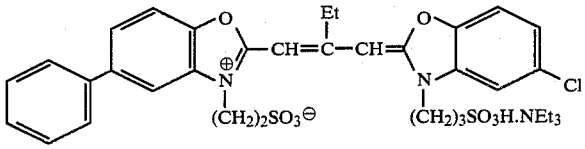
O-2
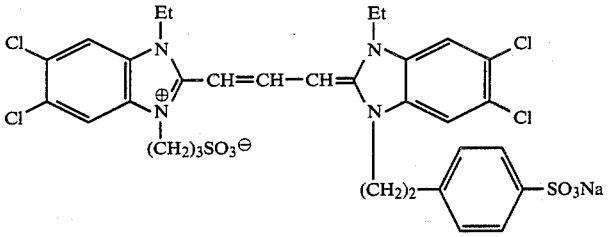
O-3
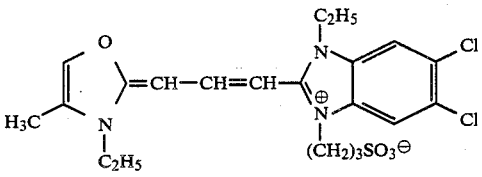
O-4
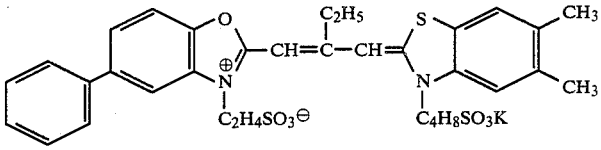

-continued

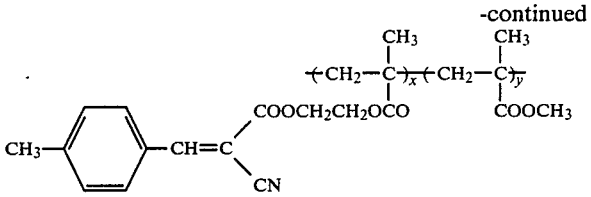

UV-1 x/y = 7/3 (by weight)

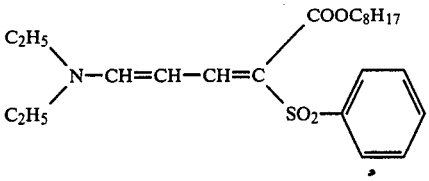

UV-2

Tricresyl phosphate

OIL-1

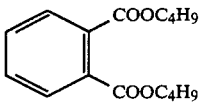

OIL-2

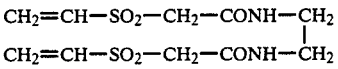

H-1

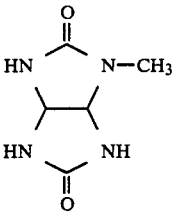

S-1

Sample No. 102 (falling within the scope of the present invention)

This Sample No. 102 was the same as Sample No. 101 with the exception of the following points:

(1) An intermediate layer (7'th layer) having the same constitution as the 5th layer was provided, as being adjacent to the 7th layer in the opposite side of the support.

(2) An additional layer (7''th layer) having the following constitution was provided between the 7'th layer and the 8th layer:

| | |
|---|---|
| Silver bromoiodide emulsion (AgBrI having an average grain size of 0.7 μm and silver iodide of 6 mol %) | 0.2 g (silver)/$m^2$ |
| Silver bromoiodide emulsion (AgBrI having an average grain size of 0.3 μm and silver iodide of 3 mol %) | 0.4 g (silver)/$m^2$ |
| Gelatin | 1.0 g/$m^2$ |
| O-4 | $5 \times 10^{-4}$ mol per mol of silver |
| C-5 (cyan coupler) | 0.07 g/$m^2$ |
| C-11 (magenta coupler) | 0.10 g/$m^2$ |
| OIL-1 | 0.10 g/$m^2$ |
| OIL-2 | 0.10 g/$m^2$ |

(3) The coating amount of each of the following layers was changed as described below, in order to correct the sensitivity and the contrast of the green-sensitive layers and the red-sensitive layers because of the introduction of said 7'th layer and 7''th layer.

| | |
|---|---|
| Coating amount of 3rd layer: | 90% |
| Coating amount of 4th layer: | 85% |
| Coating amount of 6th layer: | 90% |
| Coating amount of 7th layer: | 90% |

Sample No. 103 (comparative sample)

Sample No. 103 was the same as Sample No. 102, with the exception of the following point:

Instead of 0–4:

| | |
|---|---|
| O-1 | $2 \times 10^{-4}$ mol per mol of silver |
| O-2 | $0.8 \times 10^{-4}$ mol per mol of silver |

were used.

Sample No. 104 (comparative sample)

Sample No. 104 was the same as Sample No. 102 with the exception of the following point:

Instead of 0–4:

| | |
|---|---|
| P-1 | $2 \times 10^{-4}$ mol per mol of silver |
| P-2 | $0.6 \times 10^{-4}$ mol per mol of silver |

were used.

Sample No. 105 (present invention)

Sample No. 105 was the same as Sample No. 102 with the exception of the following point:

Instead of 0–4:

| | |
|---|---|
| P-1 | $5.3 \times 10^{-4}$ mol per mol of silver |

was used.

Sample No. 106 (present invention)

Sample No. 106 was the same as Sample No. 102 with the exception of the following point:

C-11 was omitted, and the coating amount of each of the 6th and 7th layers was restored to the 100% value so as to compensate for the sensitometry curve.

Sample No. 107 (comparative sample)

Sample No. 107 was the same as Sample No. 102 with the exception of the following point:

C-5 and C-11 were omitted, and the coating amount of each of the 3rd, 4th, 6th and 7th layers was restored to the 100% value so as to compensate for the sentitometry curve.

The values of $\bar{\lambda}_G$ and $\bar{\lambda}_R$ were obtained on each of Sample Nos. 101 through 107, according to the method as mentioned hereinbefore, and the values of $\bar{\lambda}_{RG}-\bar{\lambda}_G$ and $\bar{\lambda}_R-\bar{\lambda}_{RG}$ were calculated therefrom. The results are set forth hereinafter.

The samples were developed and treated as follows: In the first place, each of the samples was subjected to 25 CMS exposure by the use of a tungsten light source, where the color temperature was adjusted to 4,800° K. with a filter, and then the thus exposed samples were subjected to development treatment at 38° C. in accordance with the following steps:

| | |
|---|---|
| Color Development | 3 min 15 sec |
| Bleaching | 6 min 30 sec |
| Water Washing | 2 min 10 sec |
| Fixation | 4 min 20 sec |
| Water Washing | 3 min 15 sec |
| Stabilization | 1 min 05 sec |

The composition of the treating solution used in each of the above steps was as follows:

| | |
|---|---|
| Color Developer Solution: | |
| Diethylenetriaminetetraacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N—Ethyl-N—β-hydroxyethylamino)-2-methylaniline Sulfate | 4.5 g |
| Water to make | 1.0 liter |
| pH | 10.0 |
| Bleaching Solution: | |
| Ethylenediaminetetraacetic Acid Iron (II)-Ammonium Salt | 100.0 g |
| Ethylenediaminetetraacetic Acid Disodium Salt | 10.0 g |
| Ammonium Bromide | 150.0 g |
| Ammonium Nitrate | 10.0 g |
| Water to make | 1.0 liter |
| pH | 6.0 |
| Fixer Solution: | |
| Ethylenediaminetetraacetic Acid Disodium Salt | 1.0 g |
| Sodium Sulfite | 4.0 g |
| Ammonium Thiosulfate Aqueous Solution (70%) | 175.0 ml |

-continued

| | |
|---|---|
| Sodium Bisulfite | 4.6 g |
| Water to make | 1.0 liter |
| pH | 6.6 |
| Stabilizer Solution: | |
| Formalin (40 wt % formaldehyde) | 2.0 ml |
| Polyoxyethylene-p-monononylphenylether (average polymerization degree = 10) | 0.3 g |
| Water to make | 1.0 liter |

| Sample No. | $\lambda_{RG}-\bar{\lambda}_G$ | $\bar{\lambda}_R-\lambda_{RG}$ | $\lambda_{RG}$ |
|---|---|---|---|
| 101 (Comparative Sample) | — | — | — |
| 102 (Present Sample) | 47 nm | 27 nm | 595 nm |
| 103 (Comparative Sample) | −3 nm | 77 nm | 545 nm |
| 104 (Comparative Sample) | 72 nm | 2 nm | 620 nm |
| 105 (Present Sample) | 62 nm | 12 nm | 610 nm |
| 106 (Present Sample) | 47 nm | 27 nm | 595 nm |
| 107 (Comparative Sample) | 47 nm | 27 nm | 595 nm |

Next, each of Sample Nos. 101 through 107 was exposed for sensitometry and then developed and treated in the same manner as mentioned above.

These samples were thereafter subjected to sensitometry using a Status-M-Filter (Macbeth Co.). As a result, almost equivalent sensitivity and gradation were attained in every sample.

A uniform exposure of 0.05 CMS was imparted to each of these samples from C-light source, and then the exposed samples were thereafter subjected to color development treatment and then printed on a Fuji color paper (AGL #653-258) in a gray color of D=1.0.

Figure 1B:
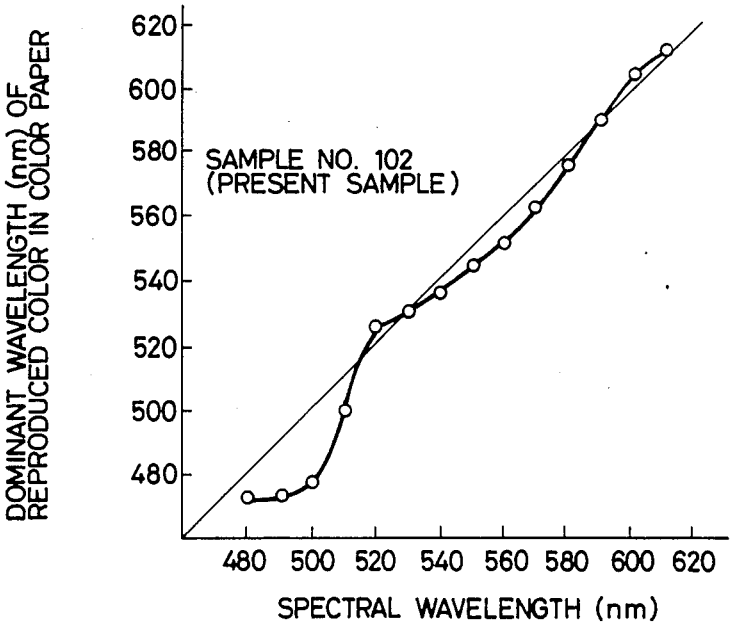
Figure 1C:
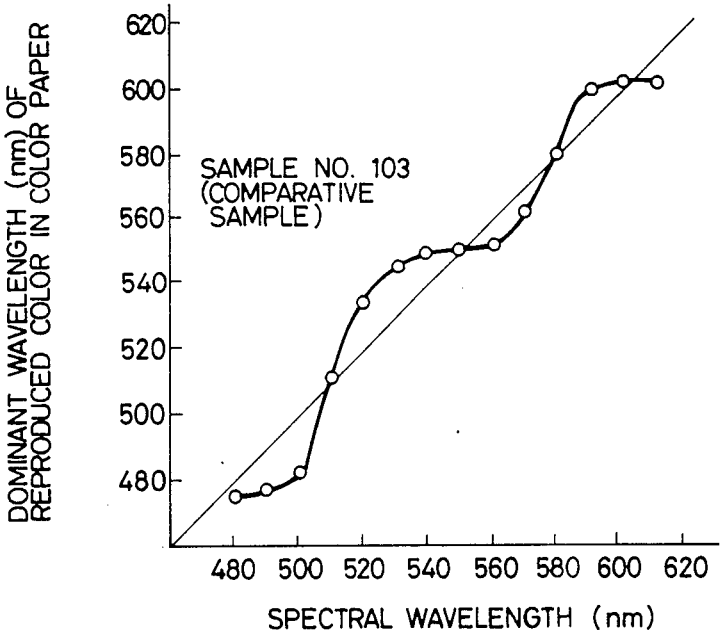
Figure 1D:
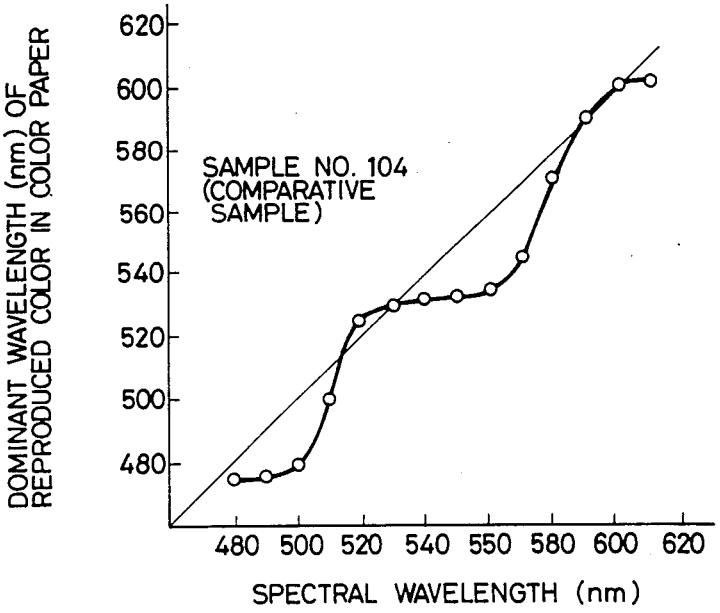
Figure 1E:
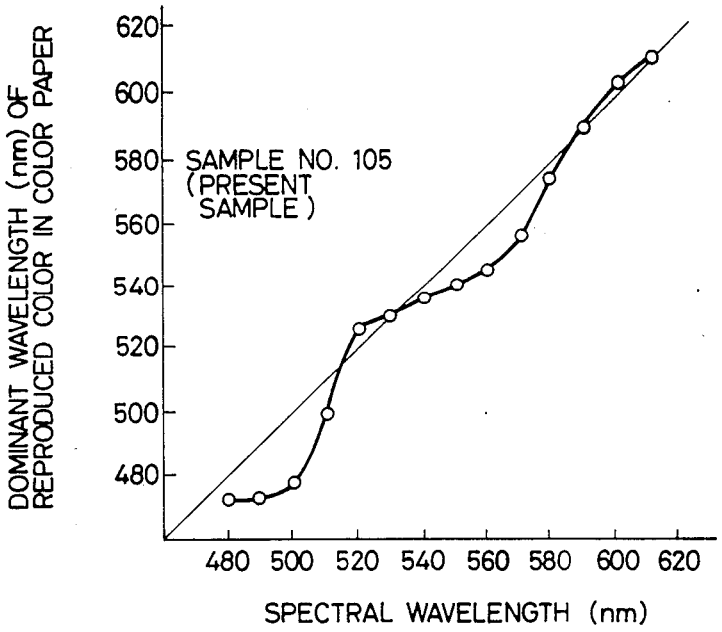
Figure 1F:
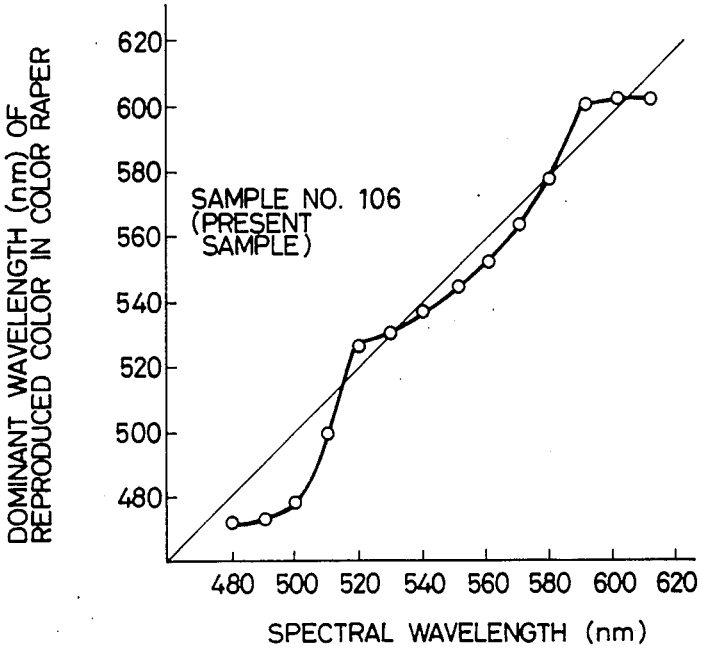
Figure 1G:
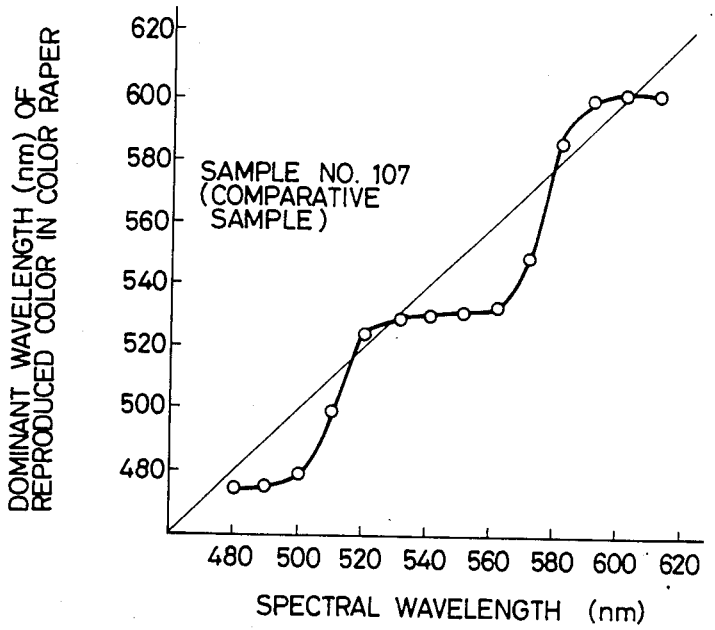

On the other hand, an exposure of 0.05 CMS was imparted to each of said samples through an interference filter in every 10 nm from λ=480 nm to λ=610 nm, and thereafter subjected to color development treatment analogously to the above and then printed under the same conditions as described above. The reproduced color of the thus obtained spectral ray was measured by the use of SS-Color Computer (Suga Electric Co., Ltd.) at every 10 nm and plotted on 1931CIE$_{xy}$-chromaticity diagram. The dominant wavelength of the reproduced color hue was obtained therefrom, and the relation of the dominant wavelength obtained and the corresponding wavelength of the interference filter is shown in FIGS. No. 1A through No. 1G. More precisely, FIG. 1A through FIG. 1G show the results of the color reproduction test of Sample Nos. 101 through 107, respectively, where the horizontal axis is a transmission maximum of the interference filter used in the exposure and the vertical axis is the dominant wavelength of the reproduced color in the color paper. In each figure, the solid line shows an ideal relation.

In conclusion:

(1) In Sample No. 101 (comparative sample), the dominant wavelength of the reproduced color to that of the spectral ray varied quite significantly from the ideal relation line within the exposure range of 480 to 510 nm and 540 to 570 nm, and thus, the color reproducibility of Sample No. 101 was bad.

(2) In Sample No. 102 (present invention), the color reproducibility was improved faithfully in a broad range of from 540 to 610 nm.

(3) In Sample No. 103 (comparative sample), the range of 540 to 570 nm was improved over that of Sample No. 101, whereas the range of 520 to 530 nm worsened. Thus, the color reproducibility could not be said to be improved from an overall viewpoint.

(4) In Sample Nos. 104 (comparative sample) and 107 (comparative sample), no improvement was observed.

(5) In Sample No. 105 (present invention), the color reproducibility was improved in the same manner as Sample No. 102.

(6) In Sample No. 106 (present invention), the ame effect could be attained, although the color reproducibility near 590 nm was somewhat inferior to that of Sample No. 102.

From the above results, the effect of the present invention is apparent. In order to further confirm this effect, each of Sample Nos. 101 through 107 was processed to a Leica size roll film and a color chart (Macbeth Co.) was photographed therewith. After photographically treating in the same manner as above, this was printed on the above mentioned color paper in the gray color. As a result, any noticeable decrement of chroma was not found in the present Sample Nos. 102, 105 and 106, and in particular, an extreme improvement was realized in the color reproduction of violet color and blue flower in the samples according to the present invention.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material having, on a support, one or more cyan coupler-containing red-sensitive silver halide emulsion layers, magenta coupler-containing green-sensitive silver halide emulsion layers, and yellow coupler-containing blue-sensitive silver halide emulsion layers, and additionally having a silver halide emulsion layer which contains at least one cyan coupler and which is spectrally sensitized such that the relation of the maximum sensitivity wavelength $\lambda_{RG}$ of the spectral sensitivity distribution thereof to the weight averaged wavelength of sensitivity $\bar{\lambda}_R$ of the spectral sensitivity distribution of said red-sensitive layer and the weight averaged wavelength of sensitivity $\bar{\lambda}_G$ of the spectral sensitivity distribution of said green-sensitive layer satisfies the formulae $$\bar{\lambda}_R-\lambda_{RG}\geqq 5 \text{ nm}$$

and $$\lambda_{RG}-\bar{\lambda}_G\geqq 5 \text{ nm}.$$

2. A silver halide color photographic material as in claim 1, wherein said relation of $\lambda_{RG}$ to $\bar{\lambda}_R$ and $\bar{\lambda}_G$ satisfies the formulae $$\bar{\lambda}_R-\lambda_{RG}\geqq 10 \text{ nm}$$

and $$\lambda_{RG}-\bar{\lambda}_G\geqq 10 \text{ nm}.$$

3. A silver halide color photographic material as in claim 1, wherein at least one photographic emulsion layer contains a DIR compound capable of releasing a highly diffusible development inhibitor or a precursor thereof.

4. A silver halide color photographic material as in claim 1, wherein at least one yellow coupler-containing blue-sensitive layer contains a cyan color image forming coupler and a DIR compound capable of releasing a highly diffusible development inhibitor or a precursor thereof.

5. A silver halide color photographic material as in claim 3, wherein said DIR compound is represented by formula (I)

$$J\text{-}(Y)_h \qquad \text{(I)}$$

wherein J represents a coupler component; h is 1 or 2; and Y represents a diffusible development inhibitor or a compound capable of releasing said development inhibitor, which is bonded with said coupler component J at its coupling position and which is released therefrom by the reaction with an oxidized form of a color developing agent, said development inhibitor has a degree of diffusibility of 0.4 or more.

6. A silver halide color photographic material as in claim 5, wherein Y in formula (I) represents a group selected from the formulae (II) to (V)

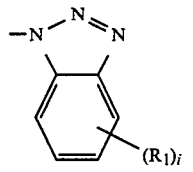
(II)

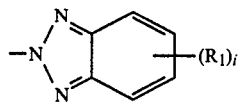
(III)

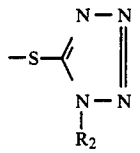
(IV)

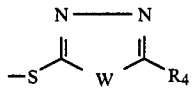
(V)

wherein W represents —S— or —N($R_3$)—; $R_1$, $R_2$, $R_3$ and $R_4$ each represents a substituent which is selected such that each compound having a degree of diffusibility of 0.4 or more; and i is an integer of 1 to 4.

7. A silver halide color photographic material as in claim 5, wherein Y in the formula (I) represents formula (VI)

$$\text{—TIME—INHIBIT} \qquad \text{(VI)}$$

wherein "TIME" represents a group which is bonded with a coupler in its coupling-position and which is cleaved by the reaction with a color developing agent, and this group can appropriately control and release the group "INHIBIT" after being cleaved off from a coupler; and "INHIBIT" represents a development inhibitor.

8. A silver halide color photographic material as in claim 2, wherein at least one photographic emulsion layer contains a DIR compound capable of releasing a highly diffusible development inhibitor or a precursor thereof.

9. A silver halide color photographic material as in claim 2, wherein at least one yellow coupler-containing blue-sensitive layer contains a cyan color image forming coupler and a DIR compound capable of releasing a highly diffusible development inhibitor or a precursor thereof.

10. A silver halide color photographic material as in claim 3, wherein at least one yellow coupler-containing blue-sensitive layer contains a cyan color image forming coupler and a DIR compound capable of releasing a highly diffusible development inhibitor or a precursor thereof.

11. A silver halide color photographic material as in claim 4, wherein said DIR compound is represented by formula (I)

$$J\text{-}(Y)_h \qquad (I)$$

wherein J represents a coupler component; h is an integer of 1 or 2; and Y represents a highly diffusible development inhibitor or a compound capable of releasing said development inhibitor, which is bonded with said coupler component J at its coupling position and which is released therefrom by the reaction with an oxidized form of a color developing agent, and said development inhibitor has a degree of diffusibility of 0.4 or more.

12. A silver halide color photographic material as in claim 11, wherein Y in formula (I) represents a group selected from the formulae (II) to (V)

(II)

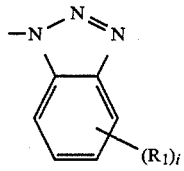

(III)

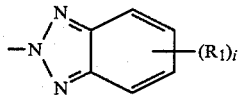

(IV)

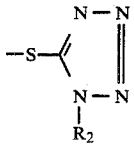

(V)

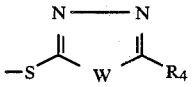

wherein W represents —S— or —N($R_3$)—; $R_1$, $R_2$, $R_3$ and $R_4$ each represents a substituent which is selected such that each compound having a degree of diffusibility of 0.4 or more; and i is an integer of 1 to 4.

13. A silver halide color photographic material as in claim 11, wherein Y in formula (I) represents formula (VI)

—TIME—INHIBIT (VI)

wherein "TIME" represents a group which is bonded with a coupler in its coupling position and which is cleaved by the reaction with a color developing agent, and this group can appropriately control and release the group "INHIBIT" after being cleaved off from a coupler; and "INHIBIT" represents a development inhibitor.

14. A silver halide color photographic material as in claim 1, wherein $$420\ \text{nm} \leqq \lambda_B \leqq 470\ \text{nm},$$
$$520\ \text{nm} \leqq \bar{\lambda}_G \leqq 560\ \text{nm},$$

and $$600\ \text{nm} \leqq \bar{\lambda}_R \leqq 670\ \text{nm}.$$

15. A silver halide color photographic material as in claim 12, wherein $R_1$ represents $CH_3$—, Br—, —NHCOR′, —$NHSO_2R'$, —OR′, —R′,

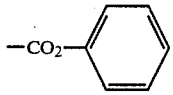

or —COR′ wherein R′ represents an aliphatic group.

16. A silver halide color photographic material as in claim 12, wherein $R_2$ represents an ethyl group, a propyl group, a hydroxy-substituted phenyl group, an amino-substituted phenyl group, a sulfamoyl-substituted phenyl group, a carboxy-substituted phenyl group, a methoxycarbonyl-substituted phenyl group, a 3-methoxy-phenyl group, —$(CH_2)_2COOR'$, —$(CH_2)_3COOR'$,

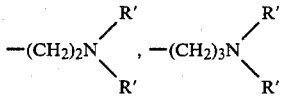

in which two R's may be the same or different, —$(CH_2)_2OCH_3$, a 3-carbamoylphenyl group or a 3-ureidophenyl group, wherein R′ represents an aliphatic group.

17. A silver halide color photographic material as in claim 12, wherein $R_3$ represents a hydrogen atom or an alkyl group having 1 to 4 carbon atoms.

18. A silver halide color photographic material as in claim 12, wherein $R_4$ represents an amino group, —NHCOR′ wherein R′ represents an aliphatic group, or

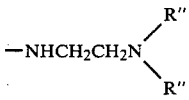

wherein two R″s may be the same or different and each represents —$(CH_2)_2SO_3H$, —$(CH_2)_3SO_3H$ or —$(CH_2)_4SO_3H$.

19. A silver halide color photographic material as in claim 15, wherein said aliphatic group is an alkyl group having 1 to 10 carbon atoms or an alkenyl group having 1 to 10 carbon atoms.

20. A silver halide color photographic material as in claim 16, wherein said aliphatic group is an alkyl group having 1 to 10 carbon atoms or an alkenyl group having 1 to 10 carbon atoms.

21. A silver halide color photographic material as in claim 18, wherein said aliphatic group is an alkyl group having 1 to 10 carbon atoms or an alkenyl group having 1 to 10 carbon atoms.

22. A silver halide color photographic material as in claim 19, wherein said alkyl or alkenyl group is substituted with one or more substituent groups selected from the group consisting of a halogen atom, a nitro group, an alkoxy group having 1 to 4 carbon atoms, an aryloxy group having 6 to 10 carbon atoms, an alkanesulfonyl group having 1 to 4 carbon atoms, an arylsulfonyl group having 6 to 10 carbon atoms, an alkanamido group having 1 to 5 carbon atoms, an anilino group, a benzamido group, an alkylcarbamoyl group having 1 to 6 carbon atoms, a carbamoyl group, an arylcarbamoyl group having 6 to 10 carbon atoms, an alkylsulfonamido group having 1 to 4 carbon atoms, an arylsulfonamido group having 6 to 10 carbon atoms, an alkylthio group having 1 to 4 carbon atoms, an arylthio group having 6 to 10 carbon atoms, a phthalimido group, a succinimido group, an imidazolyl group, a 1,2,4-triazolyl group, a pyrazolyl group, a benzotriazolyl group, a furyl group, a benzothiazolyl group, an alkylamino group having 1 to 4 carbon atoms, an alkanoyl group having 1 to 4 carbon atoms, a benzoyl group, an alkanoyloxy group having 1 to 4 carbon atoms, a benzoyloxy group, a perfluoroalkyl group having 1 to 4 carbon atoms, a cyano group, a tetrazolyl group, a hydroxy group, a carboxyl group, a mercapto group, a sulfo group, an amino group, a sulfamoyl group, an alkylsulfamoyl group having 1 to 4 carbon atoms, an arylsulfamoyl group having 6 to 10 carbon atoms, a morpholino group, an aryl group having 6 to 10 carbon atoms, a pyrrolidinyl group, a ureido group, a urethane group, an alkoxycarbonyl group having 1 to 6 carbon atoms, an aryloxycarbonyl group having 6 to 10 carbon atoms, an imidazolinyl group, and an alkylideneamino group having 1 to 6 carbon atoms.

23. A silver halide color photographic material as in claim 20, wherein said alkyl or alkenyl group is substituted with one or more substituent groups selected from the group consisting of a halogen atom, a nitro group, an alkoxy group having 1 to 4 carbon atoms, an aryloxy group having 6 to 10 carbon atoms, an alkanesulfonyl group having 1 to 4 carbon atoms, an arylsulfonyl group having 6 to 10 carbon atoms, an alkanamido group having 1 to 5 carbon atoms, an anilino group, a benzamido group, an alkylcarbamoyl group having 1 to 6 carbon atoms, a carbamoyl group, an arylcarbamoyl group having 6 to 10 carbon atoms, an alkylsulfonamido group having 1 to 4 carbon atoms, an arylsulfonamido group having 6 to 10 carbon atoms, an alkylthio group having 1 to 4 carbon atoms, an arylthio group having 6 to 10 carbon atoms, a phthalimido group, a succinimido group, an imidazolyl group, a 1,2,4-triazolyl group, a pyrazolyl group, a benzotriazolyl group, a furyl group, a benzothiazolyl group, an alkylamino group having 1 to 4 carbon atoms, an alkanoyl group having 1 to 4 carbon atoms, a benzoyl group, an alkanoyloxy group having 1 to 4 carbon atoms, a benzoyloxy group, a perfluoroalkyl group having 1 to 4 carbon atoms, a cyano group, a tetrazolyl group, a hydroxy group, a carboxyl group, a mercapto group, a sulfo group, an amino group, a sulfamoyl group, an alkylsulfamoyl group having 1 to 4 carbon atoms, an arylsulfamoyl group having 6 to 10 carbon atoms, a morpholino group, an aryl group having 6 to 10 carbon atoms, a pyrrolidinyl group, a ureido group, a urethane group, an alkoxycarbonyl group having 1 to 6 carbon atoms, an aryloxycarbonyl group having 6 to 10 carbon atoms, an imidazolinyl group, and an alkylideneamino group having 1 to 6 carbon atoms.

24. A silver halide color photographic material as in claim 21, wherein said alkyl or alkenyl group is substituted with one or more substituent groups selected from the group consisting of a halogen atom, a nitro group, an alkoxy group having 1 to 4 carbon atoms, an aryloxy group having 6 to 10 carbon atoms, an alkanesulfonyl group having 1 to 4 carbon atoms, an arylsulfonyl group having 6 to 10 carbon atoms, an alkanamido group having 1 to 5 carbon atoms, an anilino group, a benzamido group, an alkylcarbamoyl group having 1 to 6 carbon atoms, a carbamoyl group, an arylcarbamoyl group having 6 to 10 carbon atoms, an alkylsulfonamido group having 1 to 4 carbon atoms, an arylsulfonamido group having 6 to 10 carbon atoms, an alkylthio group having 1 to 4 carbon atoms, an arylthio group having 6 to 10 carbon atoms, a phthalimido group, a succinimido group, an imidazolyl group, a 1,2,4-triazolyl group, a pyrazolyl group, a benzotriazolyl group, a furyl group, a benzothiazolyl group, an alkylamino group having 1 to 4 carbon atoms, an alkanoyl group having 1 to 4 carbon atoms, a benzoyl group, an alkanoyloxy group having 1 to 4 carbon atoms, a benzoyloxy group, a perfluoroalkyl group having 1 to 4 carbon atoms, a cyano group, a tetrazolyl group, a hydroxy group, a carboxyl group, a mercapto group, a sulfo group, an amino group, a sulfamoyl group, an alkylsulfamoyl group having 1 to 4 carbon atoms, an arylsulfamoyl group having 6 to 10 carbon atoms, a morpholino group, an aryl group having 6 to 10 carbon atoms, a pyrrolidinyl group, a ureido group, a urethane group, an alkoxycarbonyl group having 1 to 6 carbon atoms, an aryloxycarbony group having 6 to 10 carbon atoms, an imidazolinyl group, and an alkylideneamino group having 1 to 6 carbon atoms.

* * * * *